US006098392A

United States Patent [19]

Tung

[11] Patent Number: 6,098,392

[45] Date of Patent: Aug. 8, 2000

[54] PROCESS FOR MAKING MULTICOLORED YARNS AND THE PRODUCT THEREOF

[75] Inventor: Wae-Hai Tung, Marietta, Ga.

[73] Assignee: E. I. du Pont de Nemours and Company, Wilmington, Del.

[21] Appl. No.: 09/091,471

[22] PCT Filed: Dec. 18, 1996

[86] PCT No.: PCT/US96/20120

§ 371 Date: Jun. 18, 1998

§ 102(e) Date: Jun. 18, 1998

[87] PCT Pub. No.: WO97/23674

PCT Pub. Date: Jul. 3, 1997

Related U.S. Application Data

[60] Provisional application No. 60/009,155, Dec. 22, 1995.

[51] Int. Cl.[7] ..... D02G 3/36

[52] U.S. Cl. ..... 57/14; 57/58.3; 57/58.36; 57/58.49; 57/3; 57/11; 57/12; 57/13

[58] Field of Search ..... 57/58.3, 58.32, 57/58.34, 58.36, 58.38, 58.49, 58.52, 58.54, 58.55, 3, 11, 12, 13, 14

[56] References Cited

U.S. PATENT DOCUMENTS

| | | | |
|---|---|---|---|
| 2,737,773 | 3/1956 | Clarkson | 57/3 |
| 2,914,903 | 12/1959 | Klein et al. | 57/58.3 |
| 3,653,198 | 4/1972 | Hopkins | 57/157 |
| 4,002,307 | 1/1977 | Turk et al. | 242/18 A |
| 4,014,476 | 3/1977 | Turk et al. | 242/19 |
| 4,460,133 | 7/1984 | Turk et al. | 242/18 A |
| 5,234,650 | 8/1993 | Hagen et al. | 264/176.1 |
| 5,263,308 | 11/1993 | Lee et al. | 57/241 |
| 5,329,755 | 7/1994 | Frentzel-Beyme et al. | 57/58.36 |
| 5,393,219 | 2/1995 | Hagen et al. | 425/382.2 |
| 5,706,642 | 1/1998 | Haselwander | 57/264 |

FOREIGN PATENT DOCUMENTS

| | | | |
|---|---|---|---|
| 0551787 | 7/1993 | European Pat. Off. | D02G 3/38 |
| 3821830 | 4/1990 | Germany | D02G 3/28 |
| 405106126 | 4/1993 | Japan | 57/58.3 |
| 06116858 | 4/1994 | Japan | D05C 17/02 |

OTHER PUBLICATIONS

Canadian Textile Journal, Sep. pp. 56–65, 1984.

*Primary Examiner*—William Stryjewski

[57] ABSTRACT

This invention relates to a new cable-twisting process for making yarns suitable for use in carpets. The process involves cable-twisting together two component yarns. At least one of the component yarns comprises two singles yarns co-twisted but not cabled together. The singles yarns may be differentially colored to provide the resulting multi-colored cable-twisted yarn with good color separation and vividness.

13 Claims, 3 Drawing Sheets

PROCESS FOR MAKING MULTICOLORED YARNS AND THE PRODUCT THEREOF

This Application claims the benefit of U.S. Provisional No. 60/009,155 filed Dec. 22, 1995.

FIELD OF THE INVENTION

This invention relates to a new cable-twisting process for making yarns suitable for use in carpets. This process involves cable-twisting two component yarns which may be differentially colored to provide a multi-colored yarn having good color separation and vividness. The invention also encompasses these resultant yarns.

BACKGROUND

Carpets having a cut-pile construction are typically used in residences, while loop-pile carpets are commonly used in commercial buildings. Carpet yarns suitable for making cut-pile and loop pile carpets are referred to as bulked continuous filament (BCF) yarns or staple spun yarns. These yarns are generally subjected to certain processing steps, such as twisting, before they are used in carpets.

In the past, BCF yarns were ring-twisted in a two-step process using ring twisters. In the first step, singles twist was imparted into each component yarn. The singles twist could be in the "S-twist direction" or the "Z-twist direction". By "S-twist direction", it is meant that when the yarn is held vertically, the spirals around its central axis slope in the same direction as the middle portion of the letter, "S". By "Z-twist direction", it is meant that when the yarn is held vertically, the spirals around its central axis slope in the same direction as the middle portion of the letter, "Z". The singles-twist component yarns were then plied together in the opposite direction of the singles twist by an equal number of turns per inch (tpi), and the singles twist was effectively removed to form a ring-twisted structure.

Today, the majority of BCF yarns are twisted in a one-step process using a cable twister. The same twisting operation as described above with the ring twisters is performed on cable twisters, except the process is done in a single step at high speeds and produces large packages suitable for subsequent heat-setting. Common cable-twister machines include the Verdol (France), Volkmann (Germany) and Muschamp (England). Generally, these cable twisters operate by feeding one component singles yarn from a yarn package located on a creel and a second component singles yarn from a yarn package located in a yarn supply bucket. The creel yarn is fed through a spinning disc and emerges to form a ballooning creel yarn. The bucket yarn is fed through a tensioner to a guide, where the creel yarn from the balloon wraps around the bucket yarn to form a cable-twisted yarn structure. This cable-twisted structure is also referred to as a two-ply cable-twisted structure, because it comprises a singles creel yarn ply-twisted with a singles bucket yarn.

In order to make a three-ply cable-twisted structure, two singles yarns are first cable-twisted together. This two-ply cable-twisted yarn is then cable-twisted with a singles yarn to produce a three-ply cable-twisted structure. Likewise, in order to make a four-ply cable-twisted structure, two singles yarns are first cable-twisted together to make one component yarn. Two different singles yarns are cable-twisted together to make a second component yarn. The first component yarn is then cable-twisted with the second component yarn to make a four-ply cable-twisted structure. These methods can also be used to make five-ply, six-ply, etc. cable-twisted structures. However, one problem with using this method to make cable-twisted yarn structures is that it involves multiple cable-twisting steps. For instance, three cable-twisting steps are necessary to make a four-ply cable-twisted yarn. Singles yarns A and B must be cable-twisted to make component yarn 1 and singles yarns C and D must be cable-twisted to make component yarn 2. Component yarns 1 and 2 are then cable-twisted to make the four-ply structure. This process is costly and time consuming due to the multiple cable-twisting steps involved. Further, the resulting yarns have a highly cabled structure.

The present invention provides a new cable-twisting process which does not involve multiple cable-twisting steps. When singles yarns of different colors are used in this process, the resulting cable-twisted multi-colored yarn exhibits an attractive color popping effect, wherein the different colors of the singles yarns are separated from each other and have good vividness.

SUMMARY OF THE INVENTION

The present invention provides a new cable-twisting process for making yarns suitable for use in carpets. In one embodiment, the process involves cable-twisting together two component yarns, wherein at least one singles yarn is fed from a creel to form a creel component yarn which is fed onto a rotating disc and emerges from the disc to form a ballooning yarn. At least two singles yarns are fed from a bucket and these yarns are co-twisted together to form a co-twisted bucket component yarn. The co-twisted bucket component yarn is fed to a yarn guide eyelet, where the creel component yarn emerges from the balloon and wraps around the bucket component yarn to form a cable-twisted yarn comprising two component yarns. The creel component yarn may be a singles yarn and the bucket component yarn may be a co-twisted yarn comprising two singles yarns co-twisted together, wherein the singles yarns are differentially colored.

In another embodiment of the process of this invention, at least two singles yarns are fed from a creel and these yarns are co-twisted together to form a co-twisted creel component yarn which is fed onto a rotating disc and emerges from the disc to form a ballooning yarn. At least one singles yarn is fed from a bucket to form a bucket component yarn. The bucket component yarn is fed to a guide, where the creel component yarn emerges from the balloon and wraps around the bucket component yarn to form a cable-twisted yarn comprising two component yarns. The creel component yarn may be a co-twisted yarn comprising two singles yarns co-twisted together and the bucket component yarn may be a singles yarn or comprise two singles yarns co-twisted together. The singles yarns of the creel component yarn and bucket component yarn may be differentially colored.

In other embodiments, the bucket component yarn may comprise two singles yarns co-twisted together and the creel component yarn may comprise three singles yarns, or four singles yarns co-twisted together. The singles yarns may be differentially colored. In another embodiment, the bucket component yarn comprises three singles yarns co-twisted together and the creel component yarn comprises three singles yarns co-twisted together.

Preferably, solution-dyed nylon yarns are used as the singles yarns. This invention also includes the cable-twisted yarns produced from the above-described processes. When differentially colored singles yarns are used, the resulting cable-twisted multi-colored yarns have good color separation.

DETAILED DESCRIPTION OF THE INVENTION

Figure 1:
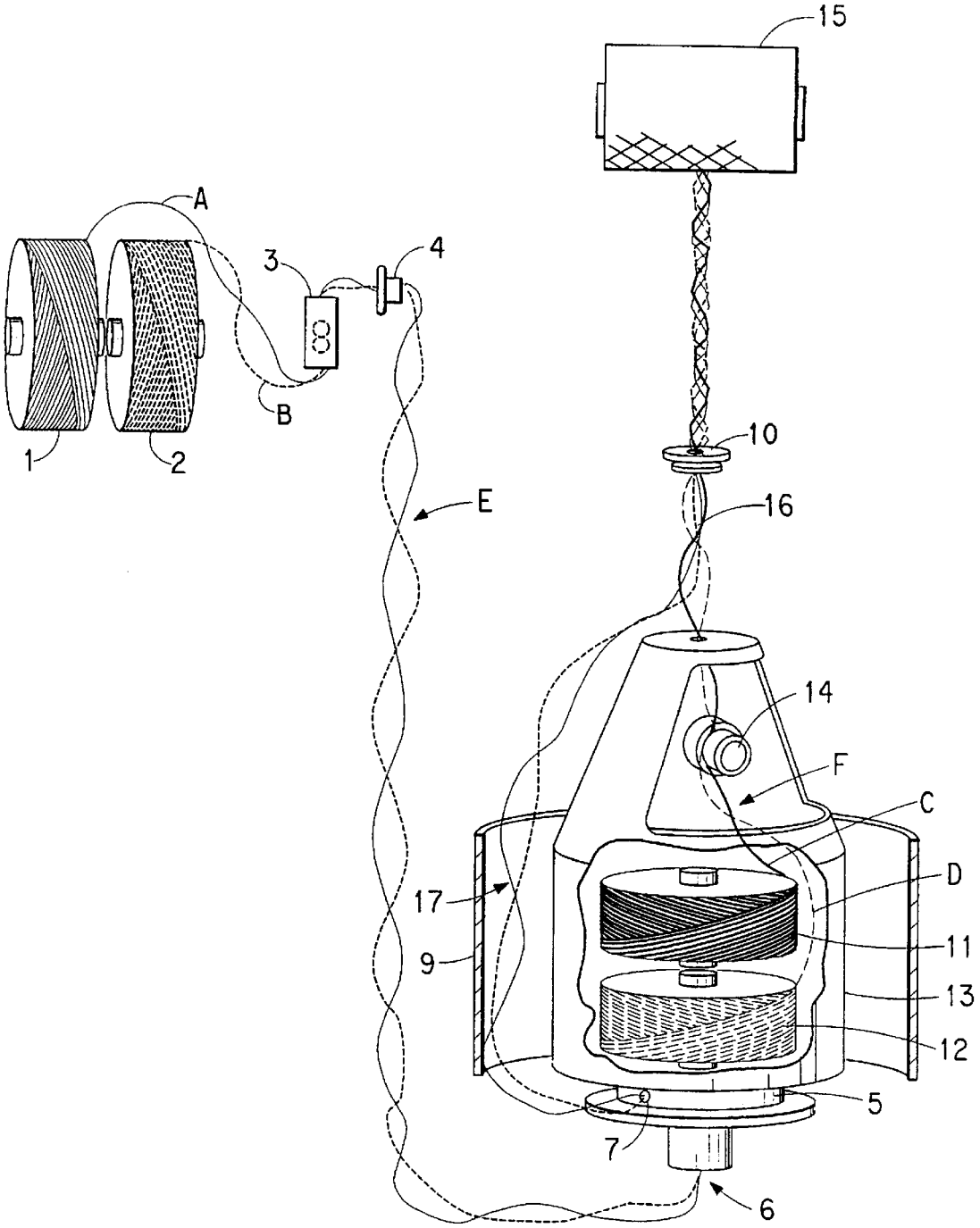
FIG. 1 is a schematic diagram of one embodiment of this invention for cable-twisting component yarns.

Referring to FIG. 1 which shows one embodiment of the process of this invention, creel yarn (A) is taken from creel package (1) and creel yarn (B) is taken from creel package (2). Creel yarns A and B are co-twisted together in a single direction to form creel component yarn (E). Creel yarns A and B may be co-twisted together in the "S-twist direction" or the "Z-twist direction". By "S-twist direction", it is meant that when the yarn is held vertically, the spirals around its central axis slope in the same direction as the middle portion of the letter, "S". By "Z-twist direction", it is meant that when the yarn is held vertically, the spirals around its central axis slope in the same direction as the middle portion of the letter, "Z". It is important that creel yarns A and B not be cable-twisted together. Component yarn E is then passed through a tensioning device (3) and through a yarn guide eyelet (4) to a rotating yarn storage disc (5). The yarn storage disc rotates around its vertical axis. The creel yarn enters the rotating storage disc at point (6) and progresses upwardly and then exits radially through hole (7). The creel component yarn is then wrapped several times around the periphery of the storage disc to form a reserve of yarn. Eventually, the creel yarn emerges from the rotating disc by centrifugal force and forms a balloon (17). A balloon limiter (9) is used to control the size of the ballooning creel yarn as it emerges from the rotating disc and enters yarn guide eyelet (10). The creel yarns should be coated with a finish in order to reduce any frictional problems with the balloon limiter. An undulator ring, as described in U.S. Pat. No. 5,329,775, may be installed above the tensioning device (14) in order to cause the ballooning creel yarn to travel in an undulating pattern and further decrease the friction between the yarns and balloon limiter.

Simultaneously, bucket yarn (C) is taken from bucket yarn package (11) and bucket yarn (D) is taken from bucket yarn package (12) which are both located in yarn supply bucket (13). Bucket yarns C and D are co-twisted together in a single direction to form bucket component yarn (F). As discussed above, bucket component yarns C and D may be co-twisted together in the "S-twist direction" or the "Z-twist direction". It is important that bucket yarns C and D not be cable-twisted together. The bucket yarn is then passed through a tensioning device (14) and enters yarn guide eyelet (10). At yarn guide (10), creel component yarn E wraps around bucket component yarn F to form a cable-twisted yarn structure (16). The resulting cable-twisted yarn (16) is then wound-up to form yarn package (15). At any given storage disc speed, the speed of wound package (15) on the wind-up roll (not shown) determines the number of turns per inch (tpi) of cable-twist which is produced in the final yarn. The tensions of creel yarns (A) and (B) and bucket yarns (C) and (D) should be substantially the same in order to obtain a cable-twisted yarn having balanced twist. Otherwise, the yarn under higher tension forms a straight core, and the yarn under lower tension wraps around this core. The tensioning devices (3) and (14) may be adjusted to provide the component yarns with approximately equal tension.

For cut-pile carpets, the cable-twisted yarn may then be heat-treated in its twisted condition by passing the yarn through a continuous heat-setting machine known as a "Superba" which treats the yarn with pressurized saturated steam to heat-set the twist. Another method involves passing the yarn through a continuous heat-setting machine known as a "Suessen" which treats the yarn with dry heat to heat-set the twist. The cable-twisted, heat-set yarns are then needled into a carpet backing material as loops which are then cut and sheared to form carpet pile tufts. For loop-pile carpets, the cable-twisted yarns may be heat-treated if such a step is commercially practical, but this is not necessary. Also, for loop-pile carpets, the yarns are needled through the carpet backing as loops, but the loops are not cut.

Any singles yarn suitable for cable-twisting may be used in the process of this invention. The yarns may be spun staple or bulked continuous filament (BCF) yarns. Preferably, the singles yarns used in the process are multifilament yarns containing filaments made from synthetic thermoplastic polymers such as polyamides, polyesters, polyolefins, and acrylonitriles, and copolymers, or blends thereof. These polymers are used to prepare polymer melts or solutions which are extruded through spinnerets to form filaments by such techniques as described below.

More preferably, a nylon singles yarn is used in the process. Suitable nylon polymers which can be used to manufacture such yarns include polyhexamethylene adipamide (nylon 6,6); polycaprolactam (nylon 6) and copolymers such as nylon 6,6/nylon 6 and other nylon copolymers such as copolyamides containing hexamethylene adipamide units and units derived from an aromatic sulfonate or alkali metal salt thereof such as the sodium salt of 5-sulfoisophthalic acid, 2-methyl-pentamethylenediamine (MPMD), caprolactam, dodecanedioic acid, isophthalic acid, terephthalic acid or combinations thereof. One preferred nylon 6,6 copolymer contains about 1.0 to about 4.0 weights units derived from the sodium salt of 5-sulfoisophthalic acid. Another preferred copolymer is a nylon 6,6 terpolymer containing units derived from the sodium salt of 5-sulfoisophthalic acid and units derived from MPMD and isophthalic acid.

In some instances, the multifilament yarns containing these filaments are subsequently dyed, such as in a skein-dyeing process, to form colored singles yarns. The singles yarns may be dyed to different colors and then used to make a multicolored cable-twisted yarn. Alternatively, non-colored multifilament cable-twisted yarns may be used to manufacture the carpet, and the carpet is then dyed. More preferably, a method known as solution-dyeing is used to make colored filaments which are used to make colored multifilament singles yarns. These singles yarns are then used to make the cable-twisted multifilament yarns of this invention. These cable-twisted yarns have good color pop due to the color separation and vividness from the differentially colored singles yarns.

Generally, a solution-dyeing method involves incorporating pigments or dyes into the polymer melt or solution prior to extruding the blend through the spinneret to form colored filaments. The pigment may be added in neat form, as a mixture with additives, or as a concentrate wherein the pigment is dispersed in a polymer matrix. For color concentrates, one or more pigments are dispersed in a polymer matrix which may also contain such additives as lubricants and delustering agents (e.g., $TiO_2$). The color concentrate is then blended with the filament-forming polymer and the blend is spun into colored filaments. For example, Anton, U.S. Pat. No. 5,108,684, the disclosure of which is hereby incorporated by reference, involves a process where pigments are dispersed in a terpolymer of nylon 6/6,6/6,10 and pigmented pellets of the terpolymer are formed. These pellets are then remelted or "let-down" in an equal or greater amount of nylon 6, mixed thoroughly to form a uniform dispersion, resolidified, and pelletized. The resulting color concentrate is then blended with a nylon copolymer containing an aromatic sulfonate or an alkali metal salt thereof. The nylon melt-blend is then spun to form stain-resistant, colored nylon filaments.

In conventional cable-twisting operations, wherein a singles creel yarn is cable-twisted with a singles bucket yarn to form a two-ply cable-twisted structure, the denier of the singles creel yarn is typically in the range of 500 to 5000 and the denier of the singles bucket yarn is typically in the range of 500 to 5000. Further, as discussed above, in a conventional cable-twisting process, only one yarn package is placed in the yarn supply bucket of a cable-twisting machine. However, in the process of this invention, smaller yarn packages may be made, and more than one yarn package may be placed in the yarn supply bucket and/or creel. For example, the bucket yarn packages and creel yarn packages may have a length of 5.5 inches and a diameter of 11 inches, and two such yarn packages may be placed in the yarn supply bucket and/or creel of a conventional cable-twisting machine in accordance with this invention. Thus, the denier of the creel yarn and bucket yarn are each typically in the range of 500 to 5000 and preferably in the range of 250 to 2500 in the process of this invention. More preferably, the creel yarn and bucket yarn each have a denier in the range of 500 to 700 in order to provide the resulting cable-twisted yarns with the above-described color pop and separation.

Figure 2:
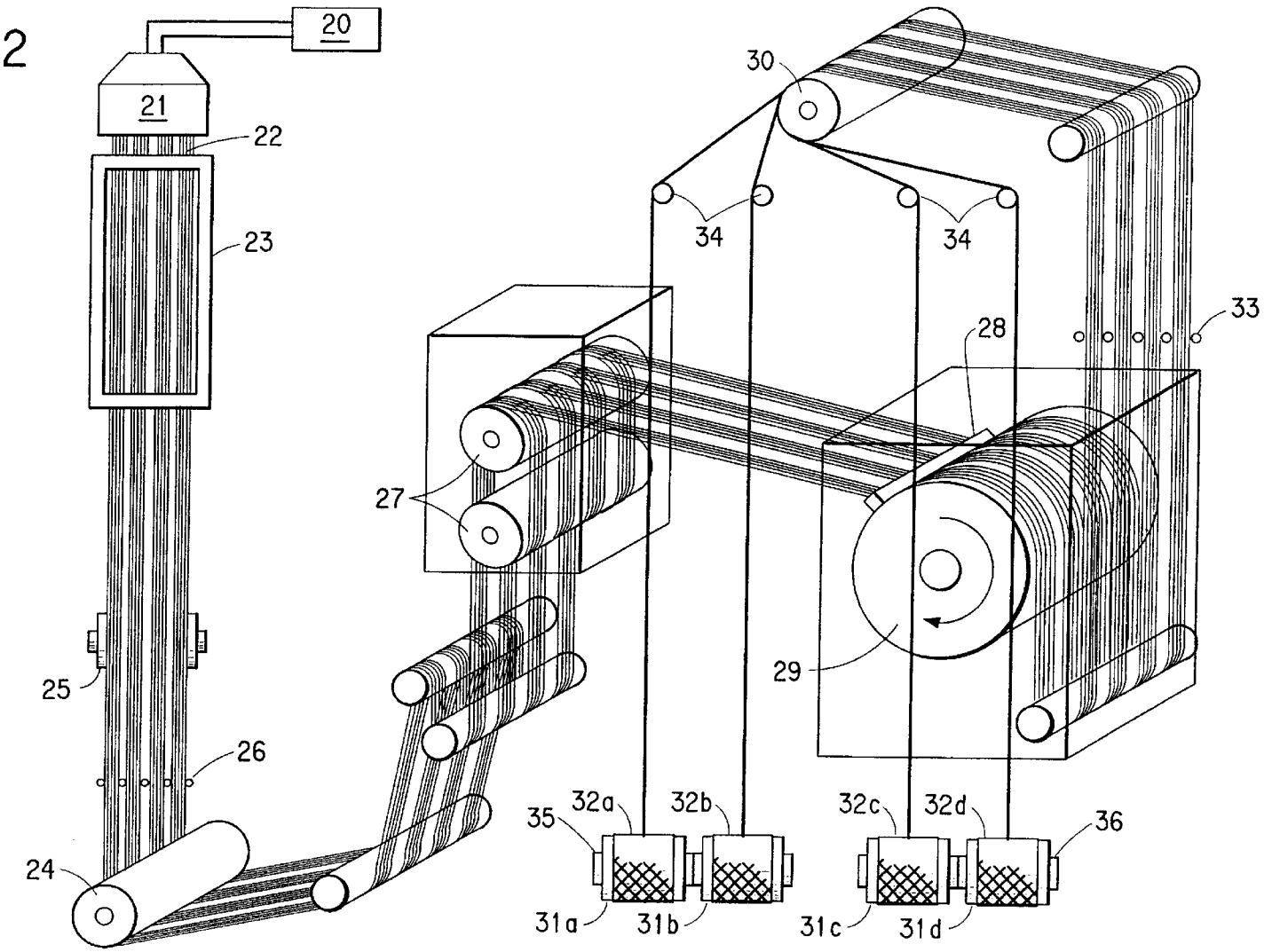
FIG. 2 is a schematic diagram of one embodiment of this invention for producing singles yarns suitable for use in the cable-twisting process.

FIG. 2 shows a process for making colored nylon singles yarns which may be subsequently used in the cable-twisting process of this invention. The process in FIG. 2 produces four yarn packages, wherein each package has approximately the same dimensions. Preferably, each yarn package has a length of 5.5 inches and a diameter of 11 inches, because such yarn packages fit within the yarn supply bucket and creel of conventional cable-twisting machines. Polyamide flake is first fed into extruder (20) along with colored pigment. The blend is then melted and pumped through spinneret (21) to form four filament bundles (22). The filaments (22) are pulled through a quench chimney (23) by means of a puller or feed roll (24). In the quench chimney, cooling air is blown past the hot filaments. After quenching, the filaments are treated with a spin-draw finish by contacting a finish applicator (25). Guide pins (26) are used to ensure that the four filament bundles are separated. Next, the filaments pass around feed roll (24) from where the filaments are drawn over a pair of draw pins by a pair of heated draw rolls (27). The resulting filaments may be crimped and cut into staple fiber or bulked and crimped to make bulked continuous filament (BCF) yarn. For BCF yarn, the filaments are heated and advanced for bulking by a four-end hot air jet (28) having four separate cavities of the type described in Breen and Lauterbach, U.S. Pat. No. 3,186,155. The hot fluid exhausts with the four threadlines against a rotating drum (29) having a perforated surface on which the yarns are cooled to set the crimp. From the drum (29), the four yarn threadlines pass to a driven take-up roll (30) and onto four rotating tube cores (31*a*), (31*b*), (31*c*), and (31*d*) to form yarn packages (32*a*), (32*b*) (32*c*), and (32*d*). Guide pins (33) and change-of-direction (COD) pins (34) are used to ensure that the four yarn threadlines are separated.

Figure 3A:
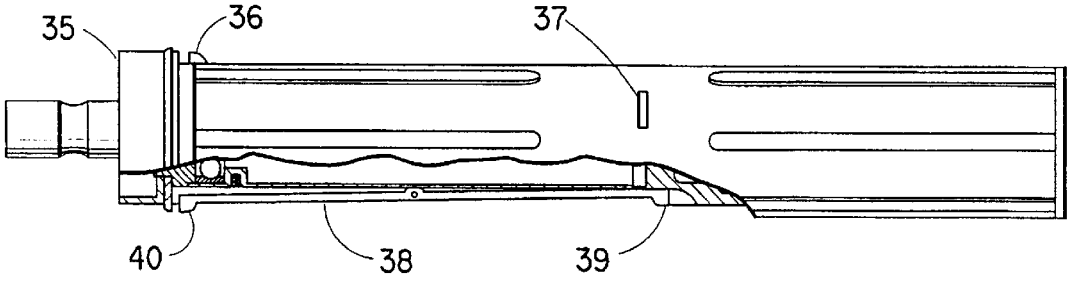
FIG. 3A illustrates a preferred chuck for winding up singles yarns of this invention with no yarn tubes loaded on the chuck.
Figure 3B:
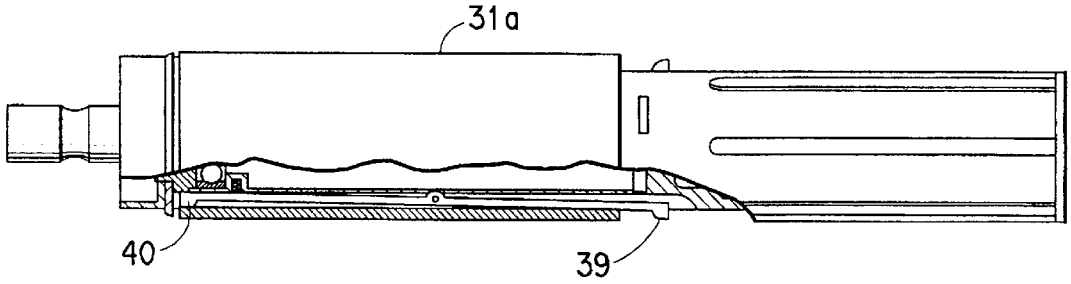
FIG. 3B illustrates a preferred chuck for winding up singles yarns of this invention with an inner yarn tube loaded on the chuck.
Figure 3C:
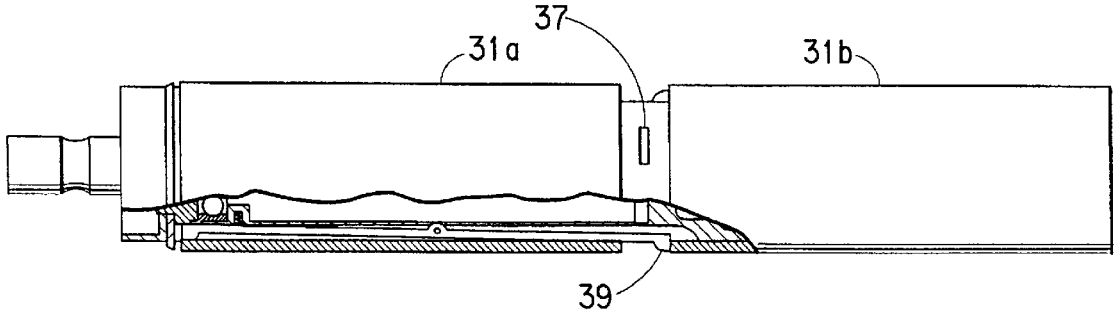
FIG. 3C illustrates a preferred chuck for winding up singles yarns of this invention with an inner yarn tube and outer yarn tube loaded on the chuck.

The two rotating tube cores (31*a*) and (31*b*) are located on a single chuck (35) which is modified to accept two cores, while the two rotating tube cores (31*c*) and (31*d*) are located on single chuck (36) which is similarly modified to accept these two cores. Each modified core has a traverse cam with two parallel tracks. Referring to FIGS. 3A, 3B, and 3C, modified chuck (35) has two snaggers; one stationary snagger (36) is located at one end of the chuck, and a spring-loaded retractable snagger (37) is located in the middle of the chuck. The modified chuck also has a positive tube stopper (38) for precise positioning of the two tube cores. When the chuck does not contain any tube cores, a spring (not shown) holds the tube stopper (38) in a retracted position. The spring-loaded retractable snagger (37) retracts to a position within the chuck during loading and unloading of the tube cores. As shown in FIG. 3B, when the inner tube core (31*a*) is slid onto the chuck, this depresses the tip end (40) of the tube stopper and raises the stop end (39). The outer tube core (31*b*) is then slid onto the chuck until it contacts the stop end (39) of the tube stopper as shown in FIG. 3C. During yarn winding and transferring (doffing), the retractable snagger extends out of the chuck.

The following Examples are illustrative of the present invention but should not be construed as limiting the scope of the invention.

EXAMPLES

In the following Examples 1–12, colored and non-colored nylon fibers were made using the four-end spinning process described above in FIG. 2. First, a random copolymer of nylon 6,6 was prepared by blending hexamethylene adipate salt, 2-methyl-pentamethylene isophthalate salt, and hexamethylene 5-sulfoisophthalate salt and polymerizing as described in Shridharani et al., U.S. Pat. No. 5,223,196, the disclosure of which is hereby incorporated by reference. The resulting polymer contained 1.25 weight percent of 5-sulfoisophthalic acid and 3.5 weight percent of amide units formed from 2-methyl-pentamethylenediamine.

Various color concentrates comprising pigments dispersed in a multipolymer system containing nylon 6/6,6/6, 10 terpolymer (Elvamide 8063 available from DuPont) and nylon 6, as described in the following Table I were made. The color concentrate was added to the nylon copolymer in an extruder to form a molten mixture which was pumped to a spinning pack through a transfer line. The molten mixture did not contain any delustrant and had a relative viscosity (RV) of 60 to 65. The temperature of the molten mixture was maintained at about 284° C. before the spinning pack. The polymer melt was spun through spinnerets within the spinning pack at a throughput of 70 pounds per hour to produce four equal size filament bundles. (The polymer melt was spun at a throughput of 52.5 pounds per hour to produce the BCF yarn in Examples 11 and 12.) Different spinnerets were used to obtain different cross-sections for the filaments. These cross-sections are described below in Table I and include a square cross-section having hollow voids as described in Champaneria et al., U.S. Pat. No. 3,745,061 and a wavy trilobal cross-section as described in Tung, U.S. Pat. No. 5,108,838 with a certain modification ratio (MR). The hot filaments were then rapidly quenched in a quench chimney, where cooling air at 10° C. was blown past the filaments at 300 to 400 cubic feet per minute (0.236 to 0.315 cubic m/sec.) The filament bundles were pulled through the quench zone by means of a feed roll rotating at a surface speed of 875 yarns per minute (800 m/min.) and then were coated with a lubricant for drawing and crimping. The filaments were then drawn at 2279 yards per minute (2.6X draw ratio) over a pair of draw pins by a pair of draw rolls heated at 200° C. The four separate filament bundles were then forwarded into a dual impingement bulking jet of the type described in Breen and Lauterbach, U.S. Pat. No. 3,186,155 with four separated cavities. The filament bundles were impinged with air at a pressure of 110 to 150 PSI and a temperature of 220 to 240° C. to form four ends of bulked continuous filament (BCF) multifilament yarn having a denier of 600. (The denier of the BCF yarn in Examples 11 and 12 was 450.)

The four ends of BCF yarn, as described above, were wound on paper tubes each having a length of 5.5 inches using the four-end wind up described above and shown in FIGS. 2 and 3. Two chucks were used in the wind-up and each chuck held two yarn packages. With the chuck stationary and the spring-loaded retractable yarn snagger in a retracted position, the inner tube was loaded onto a single chuck. After the inner tube was loaded, the stop end of the tube stop was raised, and the outer tube was then loaded on the chuck by using the extended tube stopper for proper tube positioning. For winding and doffing, the stationary snagger was used to catch yarn from the inner tube and the spring-loaded retractable snagger was used to catch yarn from the outer tube. The fully wound inner and outer yarn tubes were removed with the spring-loaded retractable snagger in a retracted position within the chuck. The outer yarn tube was removed first followed by removal of the inner tube.

TABLE 1

| Example | Denier/Denier Per Filament | Cross-Section | Color |
|---|---|---|---|
| 1 | 600/20 | Square-Hollow | Off-White |
| 2 | 600/20 | Square-Hollow | Russet |
| 3 | 600/18 | Wavy-Trilobal 2.4 MR | Puritan Gray |
| 4 | 600/18 | Wavy-Trilobal 2.4 MR | No Color |
| 5 | 600/18 | Wavy-Trilobal 2.4 MR | Anthracite |
| 6 | 600/17 | Wavy-Trilobal 2.3 MR | Egg Shell |
| 7 | 600/17 | Wavy-Trilobal 2.3 MR | Dove |
| 8 | 600/17 | Wavy-Trilobal 2.3 MR | Russet |
| 9 | 600/17 | Wavy-Trilobal 2.3 MR | Periwinkle |
| 10 | 600/17 | Wavy-Trilobal 2. 3 MR | Medium Teal |
| 11 | 450/13 | Wavy-Trilobal 2.4 MR | No Color |
| 12 | 450/13 | Wavy-Trilobal 2.4 MR | Anthracite |

In the following Examples, different BCF singles yarn samples produced in above Examples 1–12 were cable-twisted together using a Volkmann cable-twister available from Volkmann GmbH & Co., Krefeld, Germany (Model No. VTC050C50)). The BCF singles yarn samples were cable-twisted together using the process shown in FIG. 1.

Example 13

In this Example, a yarn package of BCF singles yarn produced from above Example 6 and having an egg shell color and a 600 denier was placed in the yarn supply bucket of the cable-twister and used as one bucket yarn. A yarn package of BCF singles yarn produced from above Example 5 and having an anthracite color and a 600 denier was also placed in the yarn supply bucket of the cable-twister and used as the second bucket yarn. A yarn package of BCF singles yarn produced from above Example 3 and having a puritan gray color and a 600 denier was placed on the creel and used as the creel yarn. The first and second bucket yarns were co-twisted together to form a bucket component yarn. The creel yarn and bucket component yarn were then cable-twisted together at a twist level of 2.0 turns per inch (tpi). The resulting cable-twisted yarn exhibited vivid color separation from its three singles yarns. This resulting cable-twisted yarn was tufted into a carpet using a ⅛ inch tufting gauge machine to form an automotive cut-pile carpet having a pile height of ½ inches.

Example 14

In this Example, a yarn package of BCF singles yarn produced from above Example 5 and having an anthracite color and a 600 denier was placed in the yarn supply bucket of the cable-twister and used as one bucket yarn. A yarn package of BCF singles yarn produced from above Example 6 and having an egg shell color and a 600 denier was also placed in the yarn supply bucket of the cable-twister and used as the second bucket yarn. A yarn package of BCF singles yarn produced from above Example 3 and having a Puritan Gray color and a 600 denier was placed on the creel and used as one creel yarn. A yarn package of BCF singles yarn produced from above Example 7 and having a Dove color and a 600 denier was placed on the creel and used as the second creel yarn. The first and second creel yarns were co-twisted together to form a creel component yarn, and the first and second bucket yarns were co-twisted together to form a bucket component yarn. The creel and bucket component yarns were then cable-twisted together at a twist level of 2.0 turns per inch (tpi). The resulting cable-twisted yarn exhibited vivid color separation from its four singles yarns. This resulting cable-twisted yarn was tufted into a carpet using a 1/10 inch tufting gauge machine to form a loop-pile carpet having a pile height of 3/16 inches.

Example 15

In this Example, a yarn package of BCF singles yarn produced from above Example 6 and having an egg shell color and a 600 denier was placed in the yarn supply bucket of the cable-twister and used as the first bucket yarn. A yarn package of BCF singles yarn produced from above Example 9 and having a periwinkle color and a 600 denier was also placed in the yarn supply bucket of the cable-twister and used as the second bucket yarn. A yarn package of BCF singles yarn produced from above Example 8 and having a Russet color and a 600 denier was placed on the creel and used as one creel yarn. A yarn package of BCF singles yarn produced from above Example 7 and having a Dove color and a 600 denier was placed on the creel and used as the second creel yarn. A yarn package of BCF singles yarn produced from above Example 10 and having a Medium Teal color and a 600 denier was placed on the creel and used as the third creel yarn. The first, second, and third creel yarns were co-twisted together to form a creel component yarn, and the first and second bucket yarns were co-twisted together to form a bucket component yarn. The creel and bucket component yarns were then cable-twisted together at a twist level of 2.0 turns per inch (tpi). The resulting cable-twisted yarn exhibited vivid color separation from its five singles yarns. This resulting cable-twisted yarn was tufted into a carpet using a 1/10 inch tufting gauge machine to form a loop-pile carpet having a pile height of 1/4 inches.

Example 16

In this Example, a yarn package of BCF singles yarn produced from above Example 5 and having an anthracite color and a 600 denier was placed in the yarn supply bucket of the cable-twister and used as one bucket yarn. A yarn package of BCF singles yarn produced from above Example 6 and having an egg shell color and a 600 denier was also placed in the yarn supply bucket of the cable-twister and used as the second bucket yarn. A yarn package of BCF singles yarn produced from above Example 8 and having a Russet color and a 600 denier was placed on the creel and used as one creel yarn. A yarn package of BCF singles yarn produced from above Example 7 and having a Dove color and a 600 denier was placed on the creel and used as the second creel yarn. A yarn package of BCF singles yarn produced from above Example 9 and having a Periwinkle color and a 600 denier was placed on the creel and used as the third creel yarn. A yarn package of BCF singles yarn produced from above Example 10 and having a Medium Teal color and a 600 denier was placed on the creel and used as the fourth creel yarn. The first, second, third, and fourth creel yarns were co-twisted together, and the first and second buckets yarns were co-twisted together. The creel and bucket component yarns were cable-twisted together at a twist level of 2.0 turns per inch (tpi). The resulting cable-twisted yarn exhibited vivid color separation from its six singles yarns. This resulting cable-twisted yarn was tufted into a carpet using a 1/10 inch tufting gauge machine to form a loop-pile carpet having a pile height of 1/4 inches.

Example 17

In this Example, a yarn package of BCF singles yarn produced from above Example 8 and having a russet color and a 600 denier was placed in the yarn supply bucket of the cable-twister and used as one bucket yarn. A yarn package of BCF singles yarn produced from above Example 3 and having a Puritan Gray color and a 600 denier was also placed in the yarn supply bucket of the cable-twister and used as the second bucket yarn. A yarn package of BCF singles yarn produced from above Example 6 and having an Egg Shell color and a 600 denier was placed on the creel and used as one creel yarn. A yarn package of BCF singles yarn produced from above Example 10 and having a Medium Teal color and a 600 denier was placed on the creel and used as the second creel yarn. The first and second creel yarns were co-twisted together to form a creel component yarn, and the first and second buckets yarns were co-twisted together to form a bucket component yarn. The creel and bucket component yarns were cable-twisted together at a twist level of 4.5 turns per inch (tpi). The resulting cable-twisted yarn was then subjected to heat-treating process with pressurized saturated steam using a "Superba" machine at a temperature of 135–140° C. for a time of 1–2 minutes in order to heat-set the cable-twist in the yarn. The resulting heat-set, cable-twisted yarn exhibited vivid color separation from its four singles yarns. This resulting cable-twisted yarn was tufted into a carpet using a 1/10 inch tufting gauge machine to form a cut-pile carpet having a pile height of 5/8 inches.

What is claimed is:

1. A process for cable-twisting together two component yarns, including the steps of feeding at least one singles yarn from a creel to form a creel component yarn and feeding the creel component yarn onto a rotating disc, whereby the yarn emerges from the disc and forms a balloon, the improvement comprising:

a) feeding at least two singles yarns from a bucket and co-twisting, but not cabling, the yarns together to form a co-twisted bucket component yarn; and b) feeding the co-twisted bucket component yarn to a yarn guide eyelet, where the creel component yarn emerges from the balloon and wraps around the co-twisted bucket component yarn to form a cable-twisted yarn comprising two component yarns.

2. The process of claim 1, wherein the creel component yarn is a singles yarn and the bucket component yarn is a co-twisted yarn comprising two singles yarns co-twisted but not cabled together.

3. The process of claim 2, wherein the singles yarn of the creel component yarn and at least one of the singles yarns of the bucket component yarn are differentially colored.

4. The process of claim 3, wherein the singles yarn of the creel component yarn and the two singles yarns of the bucket component yarn are each differentially colored.

5. The process of claim 1 wherein the creel component yarn comprises two singles yarns co-twisted but not cabled together and the bucket component yarn is a co-twisted yarn comprising two singles yarns co-twisted but not cabled together.

6. The process of claim 5, wherein at least one of the singles yarns of the creel component yarn and at least one of the singles yarns of the bucket component yarn are differentially colored.

7. The process of claim 5, wherein each of the singles yarns of the creel component yarn and each of the singles yarns of the bucket component yarn are differentially colored.

8. The process of claim 5, wherein the creel component yarn comprises three singles yarns co-twisted together but not cabled.

9. The process of claim 8, wherein at least one of the singles yarns of the creel component yarn and at least one of the singles yarns of the bucket component yarn are differentially colored.

10. The process of claim 8, wherein each of the singles yarns of the creel component yarn and each of the singles yarns of the bucket component yarn are differentially colored.

11. The process of claim 5, wherein the bucket component yarn is a co-twisted yarn comprising two singles yarns co-twisted together but not cabled and the creel component yarn comprises four singles yarns co-twisted together but not cabled.

12. The process of claim 5, wherein the bucket component yarn comprises three singles yarns co-twisted together but not cabled and the creel component yarn comprises three singles yarns co-twisted together but not cabled.

13. The process of claim 1 or claim 5, wherein each of the singles yarns is a solution-dyed nylon yarn.

* * * * *